US007396270B2

(12) United States Patent
Högele et al.

(10) Patent No.: US 7,396,270 B2
(45) Date of Patent: Jul. 8, 2008

(54) METHOD FOR PRODUCING A FROSTED ENVELOPE FOR A HIGH-PRESSURE DISCHARGE LAMP

(75) Inventors: Vladimir Högele, Giengen (DE); Thomas Reiners, Bachhagel (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 512 days.

(21) Appl. No.: 11/049,986

(22) Filed: Feb. 4, 2005

(65) Prior Publication Data

US 2005/0174060 A1 Aug. 11, 2005

(30) Foreign Application Priority Data

Feb. 5, 2004 (DE) ..... 10 2004 005 903

(51) Int. Cl.
*H01J 9/00* (2006.01)
*H01J 9/24* (2006.01)

(52) U.S. Cl. ..... 445/26; 445/9; 445/58; 313/634; 313/318.02

(58) Field of Classification Search ..... 445/26, 445/58, 14, 22
See application file for complete search history.

(56) References Cited

U.S. PATENT DOCUMENTS 4,798,995 A * 1/1989 Gilliard et al. ..... 313/638
5,098,326 A * 3/1992 Gorczyca et al. ..... 445/26
5,436,533 A * 7/1995 Fromm et al. ..... 315/246
5,646,471 A * 7/1997 Scholler et al. ..... 313/25
5,924,904 A * 7/1999 Fujii et al. ..... 445/58
6,555,949 B2 * 4/2003 Becker ..... 313/318.01
6,583,564 B1 * 6/2003 Kiryu et al. ..... 313/634
6,857,926 B1 * 2/2005 Sulcs et al. ..... 445/26

FOREIGN PATENT DOCUMENTS

DE 198 34 401 2/2000

* cited by examiner

*Primary Examiner*—Sikha Roy
(74) *Attorney, Agent, or Firm*—William E. Meyer

(57) ABSTRACT

A high-pressure discharge lamp, in particular a mercury-free high-pressure discharge lamp for a vehicle headlight, has a lamp base (1) and an axially symmetrical discharge vessel (30), in whose discharge space (300) an ionizable filling, containing metal halides, and electrodes (31, 32) are arranged for producing a gas discharge. The discharge vessel (30) is provided with transparent, partial frosting (37), which is limited to a section of the inside or outside of the discharge vessel (30) extending over part of the discharge vessel circumference, this section having a well-defined position with respect to the lamp base (1). Moreover, a simple production method is proposed for partial frosting (37) which is preferably arranged on the inside of the discharge vessel (30).

3 Claims, 2 Drawing Sheets

METHOD FOR PRODUCING A FROSTED ENVELOPE FOR A HIGH-PRESSURE DISCHARGE LAMP

TECHNICAL FIELD

The invention relates to a high-pressure discharge lamp having a lamp base and an axially symmetrical discharge vessel, in whose discharge space an ionizable filling, containing metal halides, and electrodes are arranged for producing a gas discharge, the discharge vessel being provided with transparent frosting, and to a production method for such a high-pressure discharge lamp.

BACKGROUND ART

Such a high-pressure discharge lamp is disclosed, for example, in the laid-open specification DE 198 34 401 A1. This specification describes a high-pressure discharge lamp for a motor vehicle headlight, whose discharge vessel is provided on the inside or on the outside with transparent frosting. This frosting extends over the entire circumference of the axially symmetrical discharge vessel and over the entire length of the discharge vessel section which surrounds the discharge space arranged between the electrodes of the lamp. Owing to the frosting, the light emitted by the discharge arc is diffused such that flickering of the discharge arc, which is caused by, for example, vibrations, is not detected and displayed by the optical system of the headlight.

This frosting of nearly the entire surface of the discharge vessel has the disadvantage that the increased parasitic light content considerably reduces the luminous efficiency of the headlight.

DISCLOSURE OF THE INVENTION

The object of the present invention is to provide a modern high-pressure discharge lamp, such as a mercury-free high-pressure discharge lamp, which is compatible with optical systems of vehicle headlights of older types, which were designed for mercury-containing high-pressure discharge lamps, for example. In particular, the high-pressure discharge lamp should satisfy the requirements according to the specification ECE Regulation 99 as regards the width of the discharge arc. Moreover, the object of the invention is to provide a simple production method for such a high-pressure discharge lamp.

This object is achieved according to the invention by a high-pressure discharge lamp having a lamp base and an axially symmetrical discharge vessel, in whose discharge space an ionizable filling, containing metal halides, and electrodes are arranged for producing a gas discharge, the discharge vessel being provided with transparent frosting, wherein said transparent frosting is formed as partial frosting of the discharge vessel in the region of the discharge space and is limited to a section of the inside or outside of the discharge vessel extending over part of the discharge vessel circumference, this section having a well-defined position with respect to the lamp base. Particularly advantageous embodiments of the invention are described in the dependent patent claims.

The high-pressure discharge lamp according to the invention has a lamp base and an axially symmetrical discharge vessel, in whose discharge space an ionizable filling, containing metal halides, and electrodes are arranged for producing a gas discharge, the discharge vessel being provided with transparent frosting which is formed according to the invention as partial frosting of the discharge vessel in the region of the discharge space and is limited to a section of the inside or outside of the discharge vessel extending over part of the discharge vessel circumference, this section having a well-defined position with respect to the lamp base.

The abovementioned features ensure that the high-pressure discharge lamp according to the invention satisfies the specification according to ECE Regulation 99 as regards the width of the discharge arc without the frosting causing a considerable reduction in the luminous efficiency, as in the case of the high-pressure discharge lamp according to the prior art. The invention can particularly advantageously be used for high-pressure discharge lamps which have a discharge arc which is heavily constricted compared to conventional high-pressure discharge lamps, such as mercury-free high-pressure discharge lamps whose ionizable filling comprises xenon and metal halides. The partial frosting of the discharge vessel and the well-defined physical alignment of this partial frosting with respect to the lamp base mean that these high-pressure discharge lamps also satisfy the specification according to ECE Regulation 99 as regards the width of the discharge arc, since the light emitted by the discharge arc is diffused at the partial frosting of the discharge vessel and thus causes the discharge arc to be widened when projected.

The partial frosting of the discharge vessel advantageously extends only over a part of the discharge vessel circumference which is as small as possible in order to ensure that the luminous efficiency is not reduced too greatly owing to light diffusion. The partial frosting advantageously extends over a region of less than 35 percent of the discharge vessel circumference and preferably of less than 12 percent of the discharge vessel circumference.

The high-pressure discharge lamp according to the invention is preferably a high-pressure discharge lamp whose discharge vessel has a first end, near to the base, and a second end, remote from the base, out of which is passed a power return line which is passed back to the lamp base. Tests have shown that good results are achieved for such high-pressure discharge lamps in the abovementioned context with a frosted section of the discharge vessel, of which at least a subsection is arranged within an angular range of from 70 degrees to 200 degrees along the discharge vessel circumference, the angle on the cross-sectional plane with respect to the connecting line between the discharge vessel axis and the power return line being measured. The best results are achieved with a relatively narrow frosted section which is arranged within the angular range of 120 degrees to 160 degrees along the discharge vessel circumference or of which at least a subsection is arranged in the above mentioned angular range.

The partial frosting of the discharge vessel can be produced on the outside of the discharge vessel by it being roughened by sand blasting, by chemical etching processes or by means of another suitable, known method. However, of particular advantage is partial frosting of the inside of the discharge vessel which comprises a deposit of metal oxides on the inside of the discharge vessel, since this partial frosting can be produced in a simple manner without additional costs. The metal oxides adhering to the inside of the discharge vessel wall act as diffusion centers for the light emitted by the discharge arc.

The method according to the invention for producing a high-pressure discharge lamp according to the invention is characterized by the fact that, before the lamp base is fitted, a gas discharge, which takes place in the horizontal position between the electrodes, is produced in the sealed-off discharge vessel provided with the electrodes and the ionizable filling containing metal halides for the purpose of partially frosting the inside of the discharge vessel, and then the position of the partial frosting produced by means of the gas discharge is aligned with respect to reference points on the lamp base when the lamp base is fitted.

Tests have shown that, owing to the above-described production method according to the invention, in particular owing to the production of a gas discharge burning in the horizontal position between the electrodes, metal oxides are formed from some of the metal halides in the ionizable filling and the oxygen present as an impurity in the discharge vessel and are deposited on and adhere to the inside of the discharge vessel, specifically to the upper half of the inside of the discharge vessel. This deposit of metal oxides results in transparent partial frosting of the inside of the discharge vessel, since the metal oxides act as diffusion centers for the light emitted by the discharge arc. In accordance with the production method according to the invention, when the lamp base is fitted the discharge vessel is aligned with respect to the lamp base such that this partial frosting of the discharge vessel assumes a well-defined position with respect to reference points on the lamp base.

In the case of high-pressure discharge lamps according to the invention whose discharge vessel has a first end, near to the base, and a second end, remote from the base, out of which is passed a power return line which is passed back to the lamp base, when the lamp base is fitted the discharge vessel is aligned with respect to the lamp base and the power return line such that at least some of the frosting produced by the gas discharge is arranged within the angular range of from 70 degrees to 200 degrees, preferably within the angular range of from 120 degrees to 160 degrees, along the discharge vessel circumference, the angle on a cross-sectional plane perpendicular to the discharge vessel axis with respect to the connecting line between the discharge vessel axis and the power return line being measured. The position of the power return line on the lamp base or the abovementioned fictitious connecting line acts here as a reference for aligning the frosted section. In order to optimize the position of the frosting, when the lamp base is fitted the discharge vessel is preferably rotated in a stepped manner through a predetermined angle about its longitudinal axis, and, following each rotation, a measurement is taken of the width of the discharge arc in each position reached.

BRIEF DESCRIPTION OF THE DRAWINGS

The invention will be explained in more detail below with reference to a preferred exemplary embodiment. In the drawing.

BEST MODE FOR CARRYING OUT THE INVENTION

Figure 3:
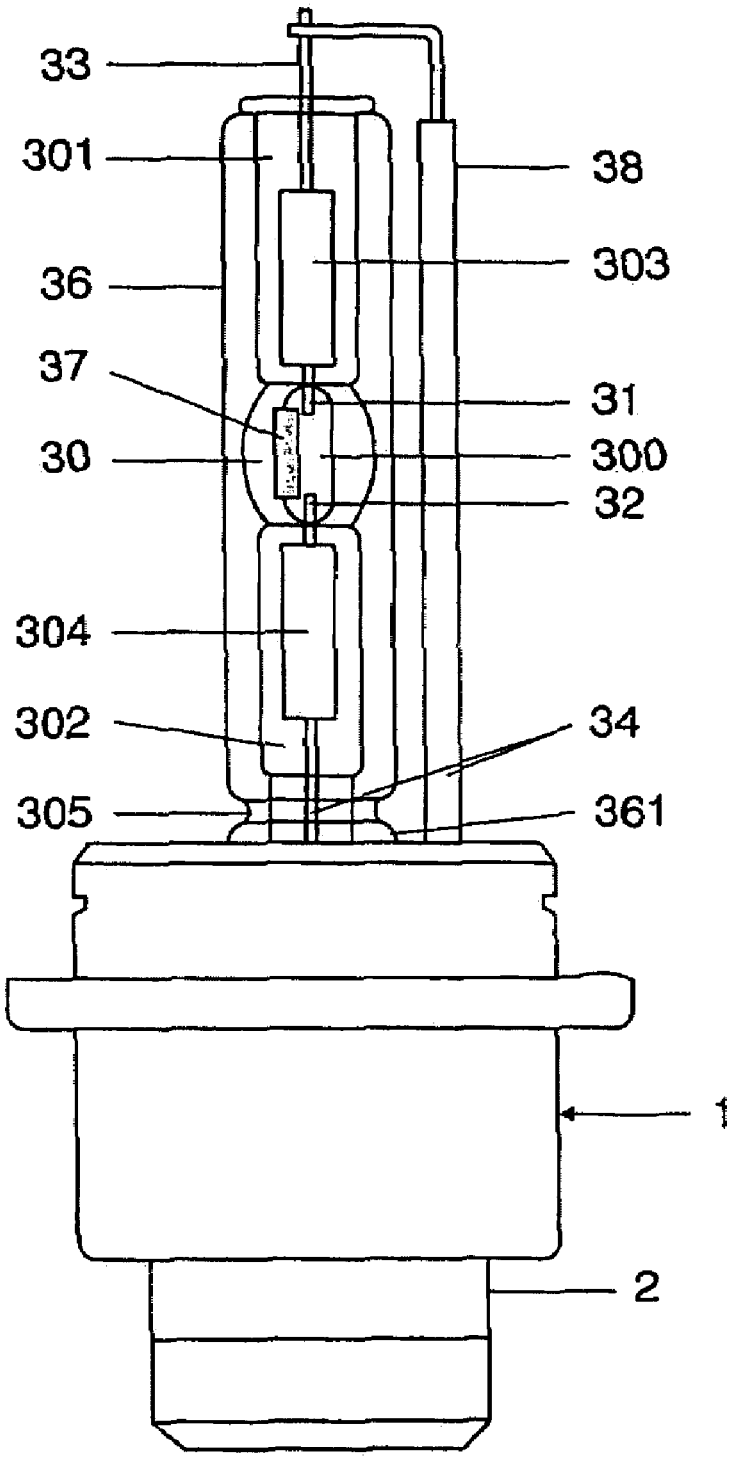
FIG. 3 shows a side view of the high-pressure discharge lamp according to the preferred exemplary embodiment.

The preferred exemplary embodiment of the invention depicted in FIG. 3 is a mercury-free high-pressure discharge lamp for a motor vehicle headlight. This high-pressure discharge lamp has an axially symmetrical discharge vessel 30 which is sealed off at two ends, is made of quartz glass, and has a first end 302, near to the base, and a second end 301, remote from the base. An ionizable filling is enclosed in a gas-tight manner in the discharge space 300 of the discharge vessel 30. The ionizable filling comprises xenon and metal halides, in particular sodium iodide, scandium iodide, zinc iodide and indium iodide. The two ends 301, 302 of the discharge vessel 30 are each sealed off by means of a molybdenum foil seal 303, 304. Two electrodes 31, 32, which are arranged diametrically along the longitudinal axis of the discharge vessel 30, protrude into the discharge space 300, the discharge arc 39 responsible for the light emission being formed between said electrodes 31, 32 during lamp operation. The electrodes 31, 32 are each electrically conductively connected to an electrical connection 2 of the lamp base 1 via one of the molybdenum foil seals 303, 304 and via the power supply line 33, remote from the base, and the power supply line 38 or via the power supply line 34 on the base side. The discharge vessel 30 is surrounded by a vitreous outer bulb 36. The outer bulb 36 has a protrusion 361 anchored in the lamp base 1. The discharge vessel 30 has a tubular extension 305 made of quartz glass on the base side, the power supply line on the base side extending in said extension 305 and for its part being connected to an electrical connection (not depicted), which is in the form of an axially arranged contact pin, of the lamp base.

Figure 1:
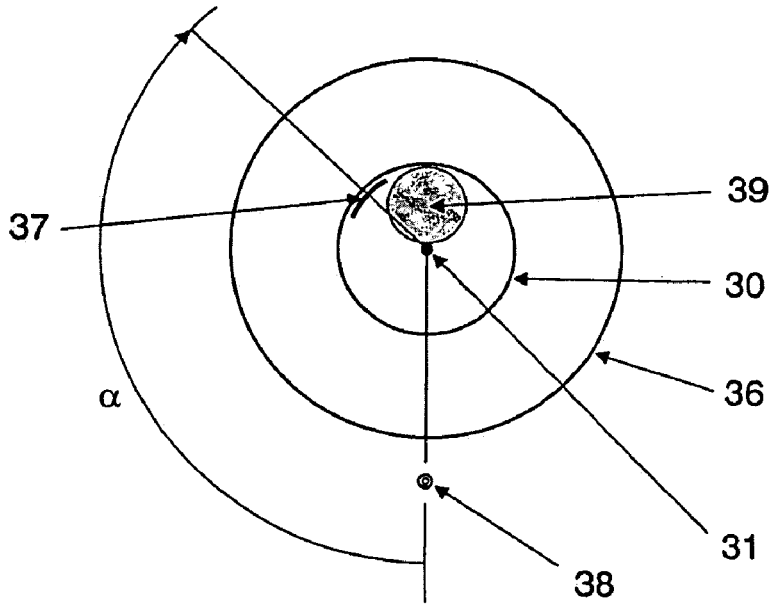
FIG. 1 shows a cross section through the discharge vessel and the outer bulb of the high-pressure discharge lamp according to the preferred exemplary embodiment on a plane perpendicular to the longitudinal axis of the discharge vessel with a plan view of that end of the discharge vessel which is remote from the base, as illustrated in FIG. 2.
Figure 2:
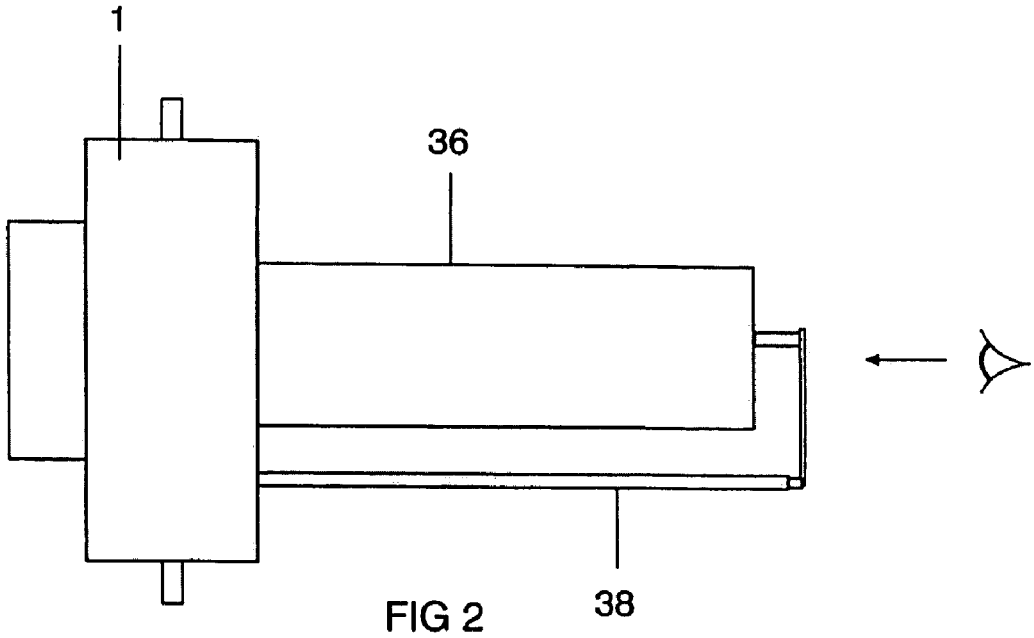
FIG. 2 shows a schematic side view of the high-pressure discharge lamp according to the preferred exemplary embodiment for the purpose of illustrating the direction of view in the illustration in FIG. 1.

The outer contour of the discharge vessel 30 corresponds to the shape of a rotational ellipsoid in the region of the discharge space 300. The inner contour of the discharge vessel 30 is circular-cylindrical in the region of the discharge space 300. The inside of the discharge vessel 30 is partially provided with transparent frosting 37 in the region of the discharge space 300. FIG. 3 shows a schematic illustration of this. The frosting 37 comprises metal oxides adhering to the inside of the discharge vessel 30. In particular, these are oxides of the metals sodium, scandium, zinc and indium contained in the ionizable filling. The frosting 37 extends in the longitudinal direction over part of the length of the discharge arc 39 and is arranged approximately centrally between the two electrodes 31, 32. The extent of the frosting 37 along the circumference of the discharge vessel 30 is approximately 30 to 40 degrees, i.e. the frosting 37 extends over approximately 8 to 11 percent of the discharge vessel circumference. The physical position of the frosting 37 is adjusted with respect to the lamp base 1. FIGS. 1 and 2 show schematic illustrations of details of the alignment of the frosting 37 with respect to the lamp base 1 and the power return line 38.

As illustrated schematically in the cross section in FIG. 1 which is aligned perpendicular to the longitudinal axis of the discharge vessel 30, the (fictitious) connecting line between the electrode 31 extending in the longitudinal axis of the discharge vessel 30 and the power return line 38 is used as a reference for adjusting the frosting 37. The frosting 37 is arranged within an angular range of approximately 120 degrees to 160 degrees along the circumference of the discharge vessel 30 in the region of the discharge space 300 on the inside of the discharge vessel. In this case, the angle $\alpha$ with respect to the abovementioned connecting line between the electrode 31 and the power return line 38 is measured. The angle $\alpha$ is measured at a direction of view according to the illustration in FIG. 2, i.e. looking at the second end 301, remote from the base, of the discharge vessel 30, in the clockwise direction against the abovementioned connecting line depicted in FIG. 1 between the electrode 31 and the power return line 38. Once the high-pressure discharge lamp has been mounted in the front headlight of a motor vehicle, the discharge vessel 30 is aligned horizontally such that the power return line 38 extends below the discharge vessel 30, as illustrated schematically in FIG. 2. This means that the frosting 37 is then on the right-hand side of the discharge vessel 30, i.e. the frosting points towards the right-hand vehicle side when the high-pressure discharge lamp has been installed.

In order to produce the frosting 37, the discharge vessel 30 provided with the electrodes 31, 32 and the ionizable filling is sealed off and aligned horizontally. A gas discharge is then produced in the ionizable filling between the electrodes 31, 32 for the duration of a few seconds. The horizontally arranged discharge arc 39 produced in the process is curved in the form of a sickle owing to convection. The oxygen present as an impurity in the discharge vessel 30 meanwhile binds some of the metals in the ionizable filling, which were introduced into the discharge vessel 30 in the form of metal halides, to form metal oxides which are deposited on the upper inside of the discharge vessel 30 owing to convection and adhere to the wall of the discharge vessel 30 there. Once this so-called burn-in process has ended, the outer bulb 36 is fixed in a known manner to the discharge vessel 30, and then the two lamp vessels 30, 36 are provided with the lamp base 1. When the lamp base 1 is fitted, the lamp vessels 30, 36 are rotated about the longitudinal axis of the discharge vessel 30 or the longitudinal axis of the outer bulb 36 until the frosting 37 has the optimum position with respect to the power return line 38. In this optimum position, the lamp vessels 30, 36 are anchored in the lamp base 1 in a known manner. In order to optimize the position of the frosting 37, the width of the discharge arc 39 is measured according to the measurement specification of ECE Regulation 99 for different alignments of the discharge vessel 30 in relation to the lamp base 1 and the power supply line 38. For this purpose, the discharge vessel 30 is rotated in the base machine in a stepped manner through 10 degrees about its longitudinal axis, and the width of the discharge arc is determined according to the specification ECE Regulation 99 for the different rotational angles. This optimization provides the above-described alignment of the frosting 37 with respect to the lamp base 1 and the power return line 38.

The width, determined according to the specification ECE Regulation 99, of the discharge arc 39 has a value of 1.19 mm with partial frosting 37 of the discharge vessel 30. Without partial frosting 37 of the discharge vessel 30, the measurement of the width of the discharge arc according to the specification ECE Regulation 99 results in a value of 0.79 mm.

The invention is not restricted to the exemplary embodiment described in more detail above. For example, instead of the partial inner frosting of the discharge vessel described in more detail above, it is also possible to carry out partial frosting of the outside of the discharge vessel.

What is claimed is:

1. A method for producing a high-pressure discharge lamp, wherein, before a lamp base is fitted to the discharge vessel, a gas discharge is produced in the discharge vessel while the discharge vessel is in a horizontal position; the sealed-off discharge vessel being provided with electrodes and an ionizable filling containing metal halides for the purpose of partially frosting the inside of the discharge vessel, the discharge arc produced between the electrodes causing a partial frosting of the discharge vessel, the discharge vessel and frosting therein then being aligned with respect to the lamp base when the lamp base is fitted to the discharge vessel.

2. The method as claimed in claim 1, wherein in the case of a high-pressure discharge lamp whose discharge vessel has a first end, near to the base, and a second end, remote from the base, out of which is passed a power return line which is passed back to the lamp base, when the lamp base is fitted the discharge vessel is aligned with respect to the lamp base and the power return line such that at least some of the frosting produced by the gas discharge is arranged within an angular range of from 70 degrees to 200 degrees along the discharge vessel circumference, the angle on a cross-sectional plane perpendicular to the discharge vessel axis with respect to the connecting line between the discharge vessel axis and the power return line being measured.

3. A method for producing a high-pressure discharge lamp, wherein, before a lamp base is fitted to the discharge vessel, a gas discharge is produced in the discharge vessel while the discharge vessel is in a horizontal position; the sealed-off discharge vessel being provided with electrodes and an ionizable filling containing metal halides for the purpose of partially frosting the inside of the discharge vessel, the discharge produced between the electrodes causing a partial frosting of the discharge vessel, the discharge vessel and the frosting therein then being aligned with respect to the lamp base when the lamp base is fitted to the discharge vessel, and wherein, in order to fit the lamp base, the discharge vessel is rotated in a stepped manner through a predetermined angle about its longitudinal axis, and, following each rotation, a measurement is taken of the width of the discharge arc in each position reached.

* * * * *